US005205056A

United States Patent [19]

Okajima et al.

[11] Patent Number: 5,205,056

[45] Date of Patent: Apr. 27, 1993

[54] ATTACHMENT STRUCTURE FOR SECURING A CLEAT TO A CYCLING SHOE

[75] Inventors: Shinpei Okajima, Izumi; Yoshinori Inubuse, Kawachinagano, both of Japan

[73] Assignee: Shimano, Inc., Osaka, Japan

[21] Appl. No.: 819,971

[22] Filed: Jan. 13, 1992

[30] Foreign Application Priority Data

Jan. 25, 1991 [JP] Japan ..... 3-1953[U]

[51] Int. Cl.[5] ..... A43B 5/00; A43B 5/14

[52] U.S. Cl. ..... 36/131; 36/134; 74/594.6

[58] Field of Search ..... 36/131, 134; 74/594.6

[56] References Cited

U.S. PATENT DOCUMENTS

| | | | |
|---|---|---|---|
| 4,377,952 | 3/1983 | Gamondes | 36/131 |
| 4,506,463 | 3/1985 | Chassaing | 36/131 |
| 4,893,420 | 1/1990 | Bezin et al. | 36/131 |
| 5,125,173 | 6/1992 | Nagano et al. | 36/131 |

FOREIGN PATENT DOCUMENTS

| | | | |
|---|---|---|---|
| 2405037 | 6/1979 | France | 36/131 |
| 2239779A | 7/1991 | United Kingdom . | |
| 2239780 | 7/1991 | United Kingdom | 36/131 |

*Primary Examiner*—Jimmy G. Foster
*Assistant Examiner*—M. D. Patterson
*Attorney, Agent, or Firm*—Dickstein, Shapiro & Morin

[57] ABSTRACT

A structure for securing a cleat to a cycling shoe includes a shoe bottom defining a recess in an upper surface thereof, and at least one slot extending through a bottom surface of the recess and parallel to a longitudinal axis of the shoe; a plate accommodate in the recess and having a fore and aft length at least half a length of the slot; a sleeve-like guide element attached to an offset position of the plate; a washer fitted in an opening defined in the cleat; and a screw extending through the washer from below for engaging the guide element. The guide element is offset to such an extent that an end of the plate is out of contact with an end wall of the recess when the guide element contacts an end of the slot lying in the direction in which the guide element is offset. The plate in this structure has a length equal to or greater than a half length of the slot, which results in a reduced extent of the slot exposed to the ground to restrict small stones, nails and the like entering the shoe. Further, since the connecting point of the plate is offset, the cleat may be fixed to any selected position over an entire range of the slot by reversing the direction of the plate.

5 Claims, 5 Drawing Sheets

ATTACHMENT STRUCTURE FOR SECURING A CLEAT TO A CYCLING SHOE

BACKGROUND OF THE INVENTION

1. Field of the Invention

The present invention relates to an attachment structure for securing a cleat to a cycling shoe.

2. Description of the Related Art

A conventional apparatus for securing a cleat has a structure including a plate mounted in a recess formed in a shoe bottom, and a clamping device connectable to the plate and having guides extending through slots formed in the recess. The plate is moved along the slots, and the clamping device is used in combination with the plate to fix the cleat to the shoe bottom.

In this structure, the plate has a length less than half the length of the slots defining a sliding range of the apparatus for positional adjustment longitudinally of the shoe. The guides are disposed centrally of the plate.

According to the conventional apparatus, therefore, the cleat may be fixed to any selected position throughout the length of the slots. However, since the plate is short, large parts of the slots are exposed to the ground. Small stones, nails and the like could enter through the exposed parts of the slots to injure the cyclist's foot.

SUMMARY OF THE INVENTION

An object of the present invention is to provide a cleat securing structure for reliably fastening a shoe to a bicycle pedal through a cleat, while allowing free longitudinally slides of a connecting position of the cleat relative to the shoe, with only small parts of slots exposed to the ground to restrict entry of small stones, nails and the like.

The above object is fulfilled, according to the present invention, by a cleat securing structure comprising a shoe bottom defining a recess in an upper surface thereof, and at least one slot extending through a bottom surface of the recess and parallel to a longitudinal axis of the shoe; a plate accommodate in the recess and having a fore and aft length at least half a length of the slot; and a clamping device connectable to an offset position of the plate and including a guide portion for extending through the slot, the clamping device being movable with the plate along the slot and cooperative with the plate to secure the cleat to a bottom surface of the shoe bottom;

According to the above structure, the plate has a length covering at least half a cleat moving range, which results in only a small part of the slot exposed to the ground. Moreover, since the connecting point of the plate is offset so that the cleat is displaced from the center of the plate, the cleat may be fixed to any selected position over the entire range of the slot by reversing the direction of the plate and sliding the plate back and forth.

Other objects and features of this invention will be understood from the following description to be had with reference to the accompanying drawings.

DETAILED DESCRIPTION OF THE PREFERRED EMBODIMENTS

Embodiments according to the present invention will be described below referring to the accompanying drawings.

Figure 1:
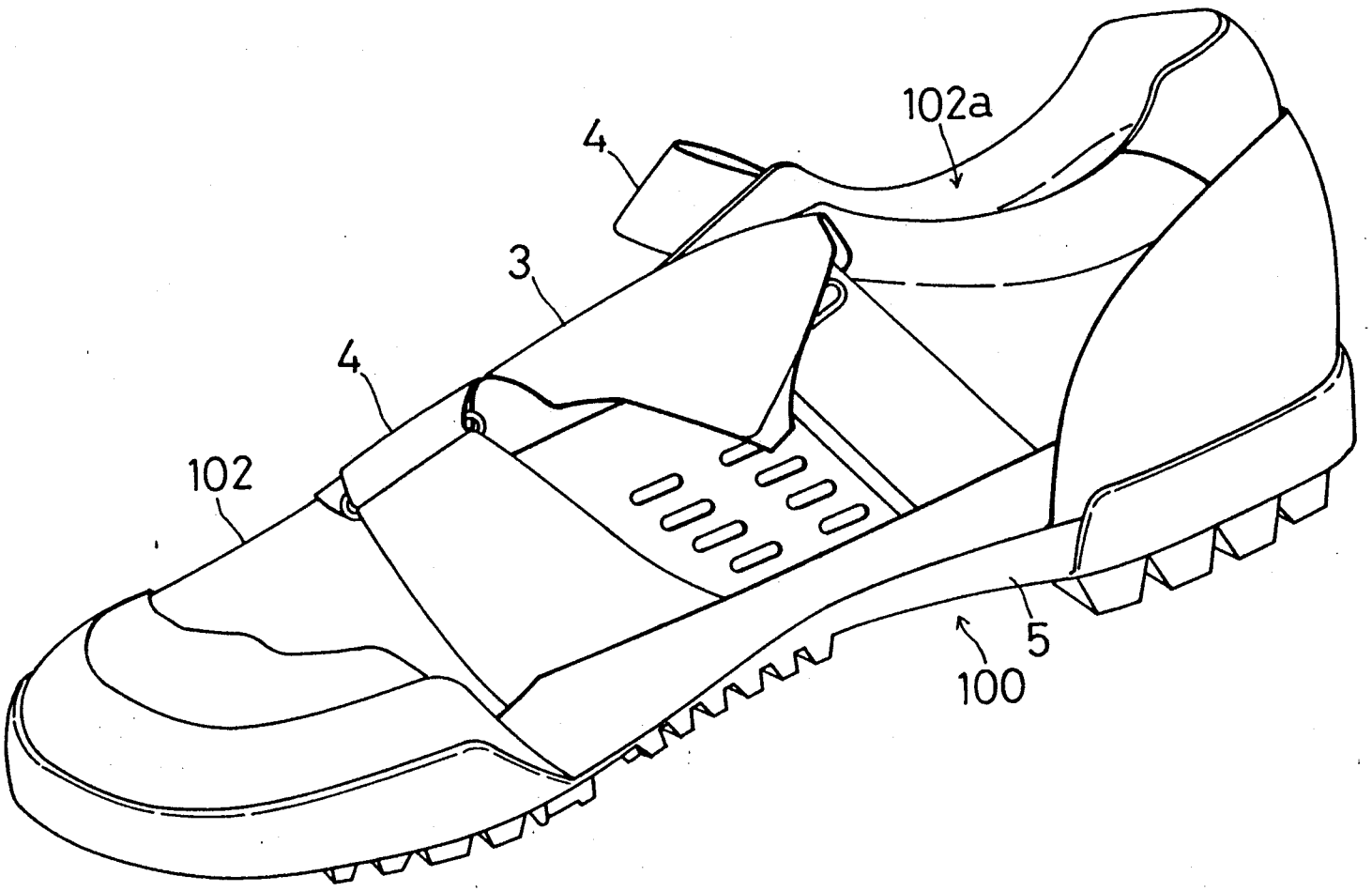
FIG. 1 is a perspective view of a shoe to which a cleat is attached.

FIG. 1 shows a shoe for use on a mountain bike. This shoe includes a shoe bottom 100 defining non-slip projections, and an upper covering 102 defining a foot receiving opening 102*a*. The covering 102 also includes a tongue 3 adjacent the opening 102*a*, and straps 4 for tightening the covering 102 to a cyclist's foot.

Figure 2:
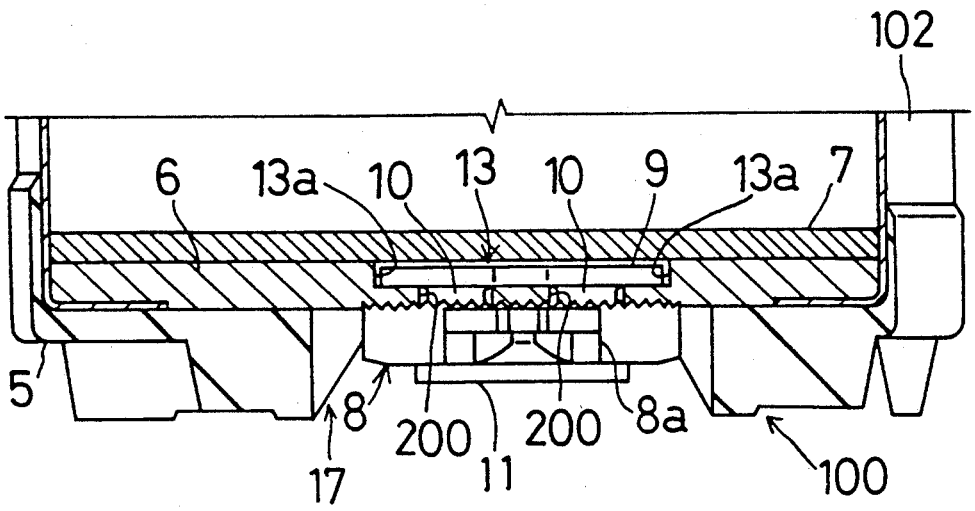
FIG. 2 is a view in cross section showing a way the cleat is fastened to a shoe bottom through a cleat securing apparatus according to the present invention.
Figure 3:
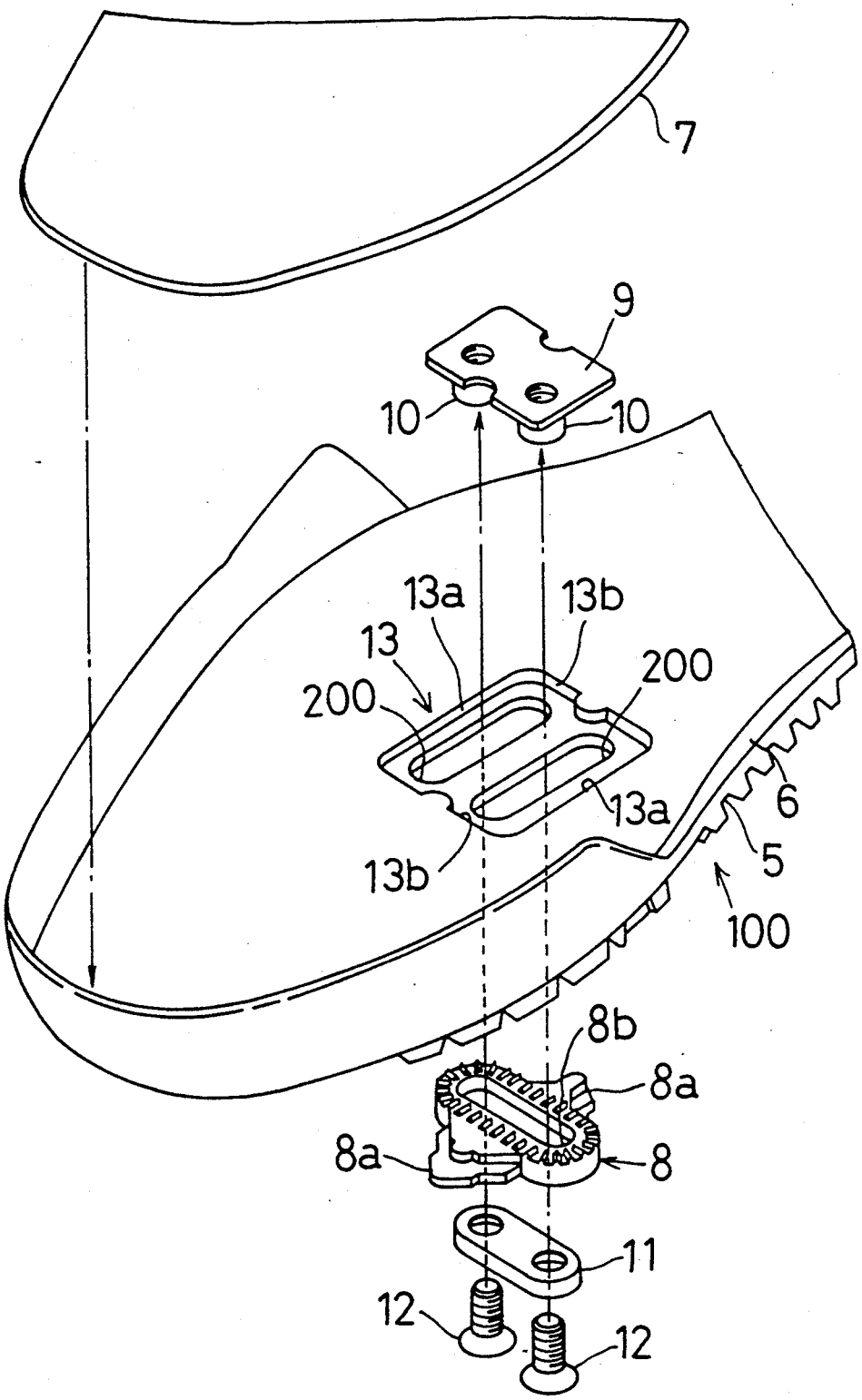
FIG. 3 is an exploded perspective view showing assembly of the shoe, cleat and cleat securing apparatus according to the present invention.

As shown in FIG. 2, the shoe bottom 100 includes a soft outsole 5 formed of rubber or the like, and a relatively hard midsole 6 placed on and bonded to the outsole 5. A platform 7 is placed on an upper surface of the midsole 6.

As shown in FIGS. 3 through 6, the midsole 6 of the shoe bottom 100 includes a pair of slots 200 formed in a forward portion thereof and extending longitudinally of the shoe. A cleat 8 is attached through these slots 200, and therefore the position and length of the slots determine attaching position and movable range of the cleat 8 relative to the shoe. The cleat 8 defines engaging pieces 8*a* projecting forwardly and backwardly as well as an opening 8*b*. For attaching the cleat 8 to the shoe, guide elements 10 attached to a plate 9 are inserted through the slots 200, and a pair of screws 12 extending through an oblong washer 11 fitted from below into the opening 8*b* of the cleat 8 is screwed tight to the guide elements 10 with the shoe bottom 100 in between.

A recess 13 is formed in the upper surface of the midsole 6 over a region enclosing the slots 200 for accommodating the plate 9. The recess 13 defines inner side walls 13*a* extending parallel to the slots 200, and end walls 13*b* continuous with the inner side walls 13*a*. The outsole 5 includes a cutout region 17 surrounding the region of recess 13 formed in the midsole 6, to avoid interference with engagement between the cleat and a bicycle pedal.

Figure 4:
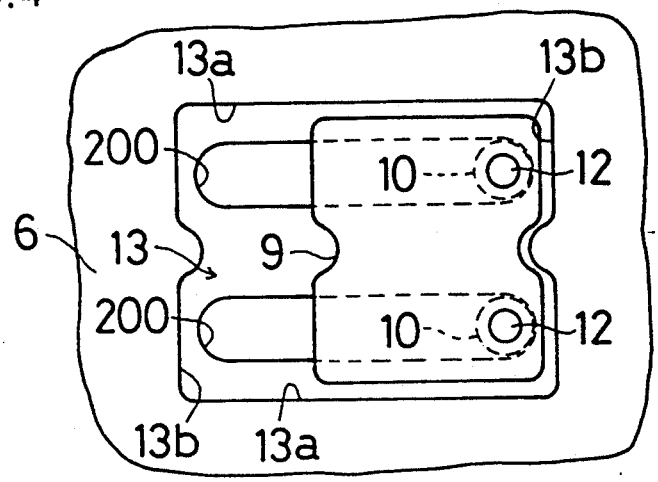
FIG. 4 is a fragmentary plan view showing guide elements on a plate contacting rear ends of slots.
Figure 5:
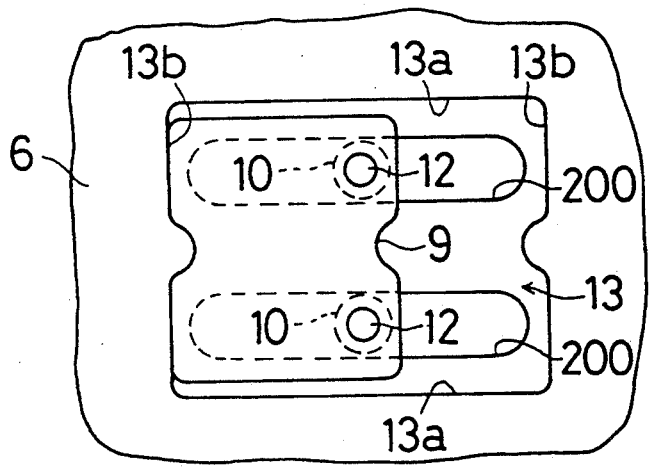
FIG. 5 is a fragmentary plan view showing the plate placed in contact with front ends of the slots.

The guide elements 10 are attached to positions of the plate 9 offset to a substantial extent forwardly or rearwardly from the center of the plate 9. As shown in FIG. 4, when the guide elements 10 are placed in contact with the ends of the slots 200 lying in the direction in which the guide elements 10 are offset, the end of the plate 9 lies short of the end wall 13*b* of the recess 13. When the plate 9 is moved to the opposite end without reversing its direction, into contact with the other end wall 13*b* of the recess 13, as shown in FIG. 5, the guide elements 10 lie in longitudinally middle positions of the slots 200 or between the middle positions and the other end wall 13*b* of the recess 13 contact by the plate 9.

Figure 6:
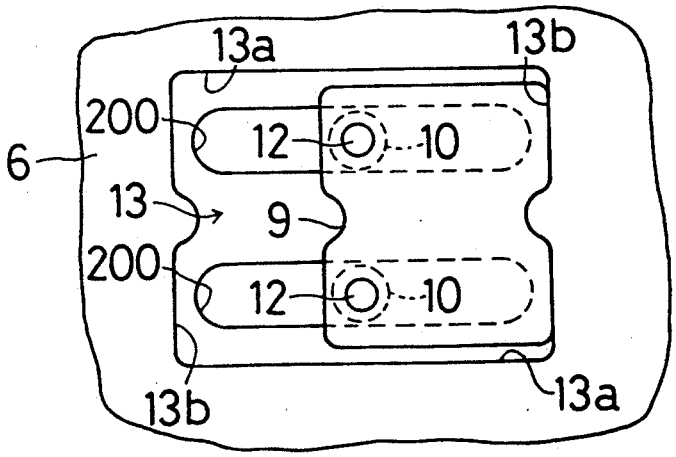
FIG. 6 is a fragmentary plan view showing the plate reversed from the direction shown in FIGS. 4 and 5 and contacting the rear ends of the slots.

Thus, in this embodiment, the recess 13 including the slots 200, the plate 9 including the guide elements 10, the washer 11, and the screws 12 for meshing with female screws defined in the guide elements 10, all combined to provide one cleat securing structure. In attaching the cleat 8 with this structure, when the plate 9 is placed as shown in FIG. 4 or 5, the cleat 8 may be fixed to any selected position over a range extending from the longitudinally middle positions to righthand ends (in FIGS. 4 through 6) of the slots 200. When the plate 9 is placed as shown in FIG. 6, the cleat 8 may be fixed to any selected position over a range extending from the logitudinally middle positions to left ends of the slots 200. In either case, large parts of the slots 200 are closed by the plate 9.

Figure 7:
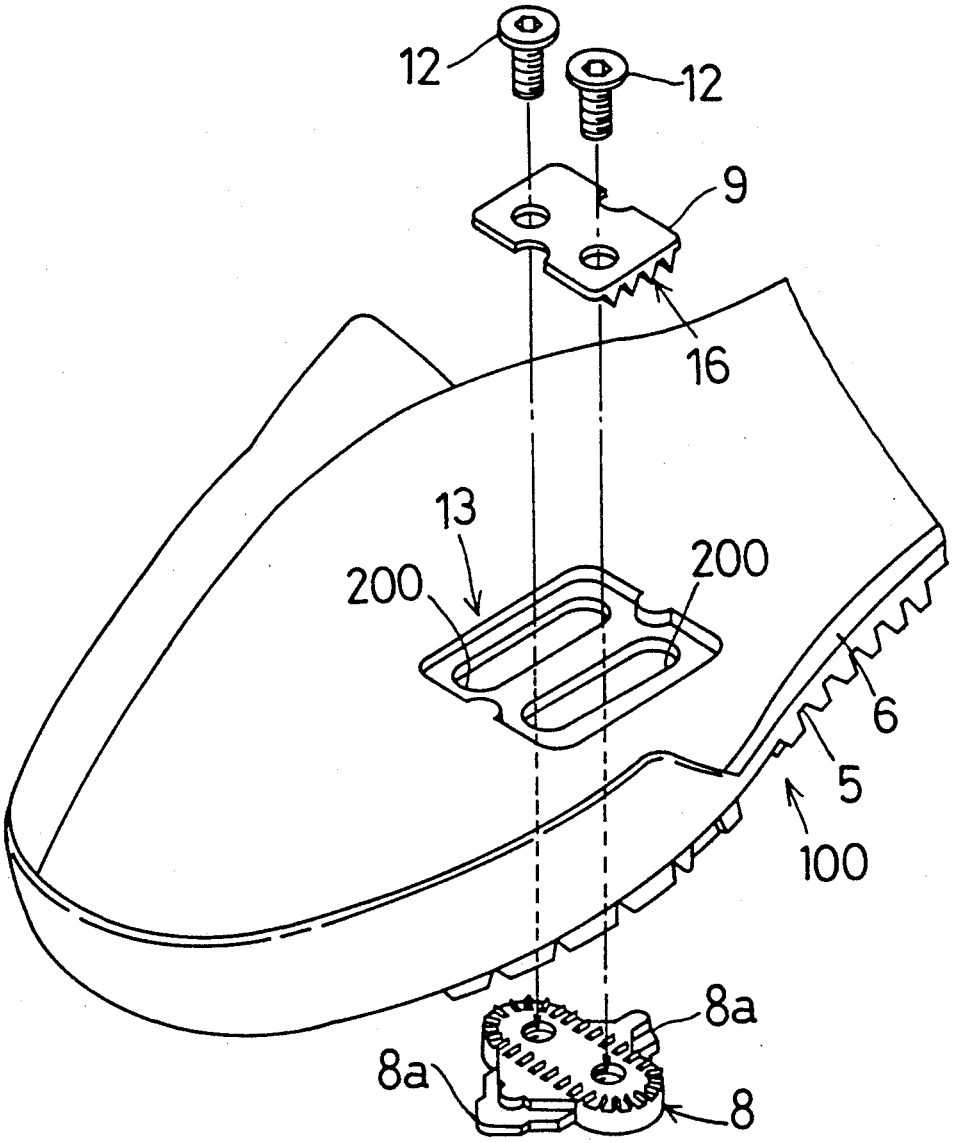
FIG. 7 is an exploded perspective view showing assembly of the shoe, cleat and cleat securing apparatus in a modified embodiment in which screws are vertically reversed.

Other embodiments will be described hereinafter. As shown in FIG. 7, the plate 9 may be in the form of an independent washer-like element defining a serrated undersurface 16, with screws 12 inserted from the upper surface of the shoe bottom 100 through the slots 200 to engage a cleat 8. The present invention is applicable also to a shoe defining a single slot 200.

What is claimed is:

1. A structure for securing a cleat to a cycling shoe comprising:

a shoe bottom defining a recess in an upper surface thereof, and at least one slot extending through a bottom surface of said recess and parallel to a longitudinal axis of the shoe;

a plate accommodated in said recess and having a fore and aft length at least half a length of said slot; and clamp means connectable to said plate and including a guide portion for extending through said slot, said clamp means allowing said plate to move along said slot, and cooperative with said plate to secure the cleat to a bottom surface of said shoe bottom;

a point of connection between said plate and said clamp means being offset from a center of said plate;

wherein an amount of offset of said clamp means is such that an end of said plate is out of contact with an end wall of said recess when said guide portion of said clamp means contacts an end of said slot lying in the direction in which said guide portion is offset; and wherein said amount of offset of said guide portion is such that, when said plate is moved, without reversing direction, into contact with the other end wall of said recess, said guide portion lies substantially in a longitudinally middle position of said slot or between said middle position and said other end wall.

2. A cleat securing structure as claimed in claim 1, wherein said clamp means includes a sleeve-like guide element attached to said plate, a washer fitted in an opening defined in the cleat, and a screw extending through said washer from below.

3. A cleat securing structure as claimed in claim 1, wherein said shoe bottom defines two slots extending parallel to each other.

4. A cleat securing structure as claimed in claim 1, wherein said recess defined in said shoe bottom has a rectangular shape.

5. A cleat securing structure as claimed in claim 1, wherein said clamp means cooperative with said plate to secure the cleat to the bottom surface of said shoe bottom being extendible downwardly through said plate and said slot for connection to said cleat.

* * * * *